US009918527B2

(12) United States Patent
Ogura

(10) Patent No.: US 9,918,527 B2
(45) Date of Patent: Mar. 20, 2018

(54) CONCEALABLE SLIDE FASTENER

(71) Applicant: YKK CORPORATION OF AMERICA, Marietta, GA (US)

(72) Inventor: Suguru Ogura, Macon, GA (US)

(73) Assignee: YKK Corporation (JP)

( * ) Notice: Subject to any disclaimer, the term of this patent is extended or adjusted under 35 U.S.C. 154(b) by 0 days.

(21) Appl. No.: 15/086,937

(22) Filed: Mar. 31, 2016

(65) Prior Publication Data

US 2017/0280833 A1 Oct. 5, 2017

(51) Int. Cl.
*A44B 19/08* (2006.01)
*A44B 19/40* (2006.01)

(52) U.S. Cl.
CPC ..... *A44B 19/08* (2013.01); *A44B 19/403* (2013.01)

(58) Field of Classification Search
CPC ..... A44B 19/08; A44B 19/403
See application file for complete search history.

(56) References Cited

U.S. PATENT DOCUMENTS 2,798,275 A * 7/1957 Morin ..... A44B 19/04 24/410
3,087,200 A * 4/1963 Morin ..... A44B 19/08 24/410
3,161,933 A * 12/1964 Doelter ..... A44B 19/08 200/16 A
3,579,748 A * 5/1971 Chery ..... A44B 19/406 112/475.16
3,668,745 A 6/1972 Krupp
3,924,305 A 12/1975 Hamamura
4,078,278 A * 3/1978 MacFee ..... A44B 19/08 24/412
2003/0000049 A1* 1/2003 Ichikawa ..... A44B 19/32 24/389
2003/0140465 A1* 7/2003 Yuki ..... A44B 19/38 24/432
2006/0130292 A1* 6/2006 Kondo ..... A44B 19/08 24/403
2007/0124900 A1* 6/2007 Himi ..... A44B 19/08 24/403
2007/0209170 A1* 9/2007 Davies ..... A44B 19/32 24/403

(Continued)

FOREIGN PATENT DOCUMENTS

JP 49015548 2/1974
JP 60180516 11/1985

(Continued)

*Primary Examiner* — Robert Sandy
*Assistant Examiner* — David M Upchurch
(74) *Attorney, Agent, or Firm* — Kilpatrick Townsend & Stockton LLP

(57) ABSTRACT

A slide fastener includes first and second rows of slide elements and first and second tapes secured with the respective rows of slide elements. The slide elements of the first row of slide elements are configured to engage with slide elements of the second row of slide elements and each slide element of the first and second rows includes a base, a head, a neck extending between the base and the head, a top surface, a facing surface, and one or more shoulders. A first vertical distance between a lowermost surface of the head and the first end of the first tape is greater than a second vertical distance between a lowermost surface of the base and the first end of the first tape.

25 Claims, 9 Drawing Sheets

(56) References Cited

U.S. PATENT DOCUMENTS

| | | | | |
|---|---|---|---|---|
| 2009/0094805 | A1* | 4/2009 | Keyaki | A44B 19/382<br>24/433 |
| 2011/0000053 | A1* | 1/2011 | Dono | A44B 19/08<br>24/399 |

FOREIGN PATENT DOCUMENTS

| | | |
|---|---|---|
| JP | 61005119 | 1/1986 |
| JP | 3580725 | 10/2004 |
| JP | 4689454 | 5/2011 |
| JP | 5501255 | 5/2014 |
| WO | 2010/089870 | 8/2010 |

* cited by examiner

CONCEALABLE SLIDE FASTENER

FIELD OF THE INVENTION

This invention relates to concealable slide fasteners with elements that engage with one another with improved strength and stability.

BACKGROUND

Slide fastener devices are used to secure two pieces of fabric, tape, or other flexible material, such as on a garment, bag, or other article. A slide fastener includes a plurality of elements located on tapes to open and close the slide fastener such that a slider engages with the elements. When the slider is moved along the tape, the rows of opposing elements of the tape mesh together to close the slide fastener. When the slider is moved in the opposite direction, the slider separates the rows of opposing elements to open the slide fastener. For applications where the slide fastener is meant to be concealed and/or meant to provide a seal, the tape may be configured such that one or more layers of tape are disposed between the rows of opposing elements.

In certain situations, it may be desirable to modify the geometry of the elements to increase stability and strength during use and operation with the tape and to increase efficiency during the manufacturing process of the elements.

SUMMARY

The terms "invention," "the invention," "this invention" and "the present invention" used in this patent are intended to refer broadly to all of the subject matter of this patent and the patent claims below. Statements containing these terms should be understood not to limit the subject matter described herein or to limit the meaning or scope of the patent claims below. Versions of the invention covered by this patent are defined by the claims below, not this summary. This summary is a high-level overview of various aspects of the invention and introduces some of the concepts that are further described in the Detailed Description section below. This summary is not intended to identify key or essential features of the claimed subject matter, nor is it intended to be used in isolation to determine the scope of the claimed subject matter. The subject matter should be understood by reference to appropriate portions of the entire specification of this patent, any or all drawings and each claim.

According to certain cases, a slide fastener includes a first row of slide elements; a second row of slide elements; a first tape secured with the first row of slide elements at a first end of the first tape; and a second tape secured with the second row of slide elements at a first end of the second tape, wherein: slide elements of the first row of slide elements are configured to engage with slide elements of the second row of slide elements; each slide element of the first and second rows comprises a base, a head, a neck extending between the base and the head, a top surface, a facing surface, and one or more shoulders; the first tape is configured to cover the facing surface and the top surface of the slide elements of the first row; the second tape is configured to cover the facing surface and the top surface of the slide elements of the second row; and a first vertical distance between a lowermost surface of the head and the first end of the first tape is greater than a second vertical distance between a lowermost surface of the base and the first end of the first tape.

According to certain cases, a slide fastener includes a first row of slide elements extending along a longitudinal direction; a second row of slide elements extending approximately parallel to the first row; a first tape having a first end that is disposed in a through hole of each of the slide elements of the first row of slide elements; and a second tape having a first end that is disposed in a through hole of each of the slide elements of the second row of slide elements; wherein: the first and second rows of slide elements are configured to engage with one another; each slide element comprises a base, a head, a neck extending between the base and the head, a top surface, a facing surface, and one or more shoulders; the slide elements are disposed such that the facing surfaces of the slide elements of the first row and the facing surfaces of the slide elements of the second row face one another; the first tape is configured to cover the facing surface and the top surface of the slide elements of the first row; the second tape is configured to cover the facing surface and the top surface of the slide elements of the second row; the first and second tapes are pressed together between the first and second rows of slide elements when the first and second rows are engaged with one another; a lowermost surface of the head of each of the slide elements is contained within a first plane that is offset from a second plane containing a lowermost surface of the base; and a forwardmost surface of the head of each of the slide elements is contained within a third plane that is offset from a fourth plane containing the facing surface of the base, wherein the facing surface is a forwardmost surface of the base.

According to certain cases, a slide element of a slide fastener includes: a base; a head positioned below and forward of the base; and a neck extending between the base and the head, wherein: a lowermost surface of the head is contained within a first plane that is offset from a second plane containing a lowermost surface of the base; and a forwardmost surface of the head is contained within a third plane that is offset from a fourth plane containing the forwardmost surface of the base.

BRIEF DESCRIPTION OF THE DRAWINGS

Illustrative embodiments of the present disclosure are described in detail below with reference to the following drawing figures.

DETAILED DESCRIPTION

The subject matter of versions of the present invention is described here with specificity to meet statutory requirements, but this description is not necessarily intended to limit the scope of the claims. The claimed subject matter may be embodied in other ways, may include different elements or steps, and may be used in conjunction with other existing or future technologies. This description should not be interpreted as implying any particular order or arrangement among or between various steps or elements except when the order of individual steps or arrangement of elements is explicitly described.

FIGS. 1A-8 depict non-limiting examples of slide fasteners. Even if different reference numbers are used in various drawings, any of the features shown or described in relation to any of the drawings may be included, combined, substituted, or omitted to provide additional examples.

Figure 1A:
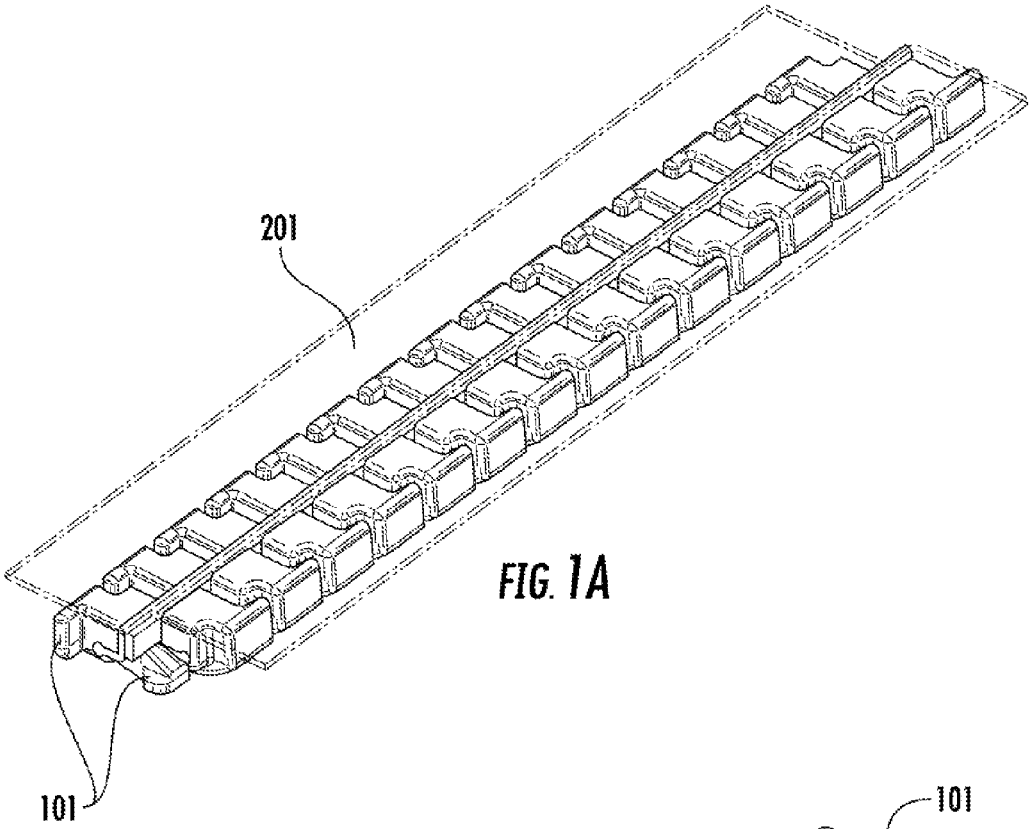
FIG. 1A is a top perspective view of a slide fastener according to certain aspects.
Figure 1B:
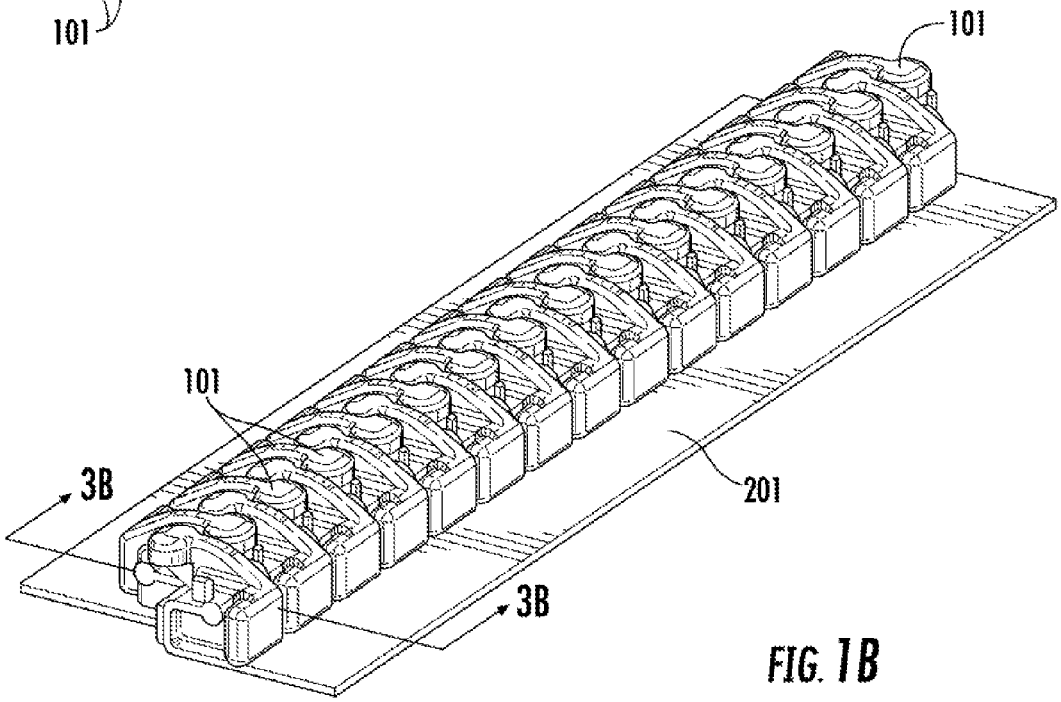
FIG. 1B is a bottom perspective view of the slide fastener of FIG. 1A.

FIGS. 1A and 1B illustrate a non-limiting example of a slide fastener that includes a plurality of slide elements 101 and tapes 201. As shown, a first row of slide elements 101 secured to a first tape 201 are configured to engage with a second row of slide elements 101 secured to a second tape 201 such that the slide elements 101 are not visible from a top side (see FIG. 1A, where the tape 201 is shown transparent). The two rows of slide elements 101 are arranged in a longitudinal direction. The slide elements 101 are configured such that each slide element 101 engages with at least one slide element 101 from the opposite row. In some examples, if a slide element 101 is disposed between ends of a row, the given slide element 101 engages with two slide elements 101 from the opposite row.

Slide fasteners, such as those described herein, are often subjected to external forces applied through the tapes 201. For example, $F_T$ (shown in FIG. 7A) represents a force that tends to pivot or rotate one of the slide elements 101. To balance the force $F_T$, the slide element 101 from a first row transfer one or more forces through the neck 104 to the head 103 where one or more forces $F_S$ are applied between the head 103 and a corresponding shoulder 105 of one or more slide elements 101 from a second row of slide elements. The slide elements 101 described herein have necks 104 that are configured to increase the capability of transferring forces through the neck 104 to counteract forces from the tape such as $F_T$. As described in greater detail below, the necks 104 are configured such that a head 103 of the slide element 101 is toward a front portion 401 of the slide element 101 and/or toward a bottom portion 404 of the slide element 101 and such that the necks 104 have increased cross-sectional areas.

Figure 5A:
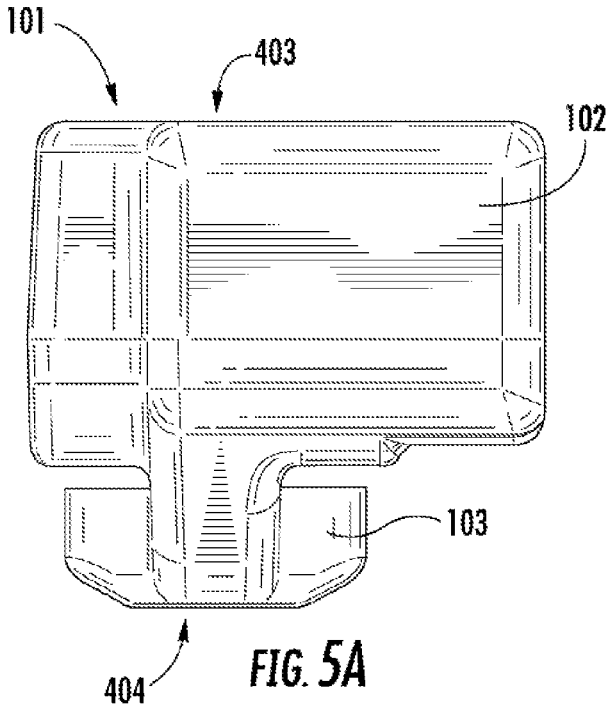
FIG. 5A is a rear end view of the slide element of the slide fastener of FIG. 2A.
Figure 5B:
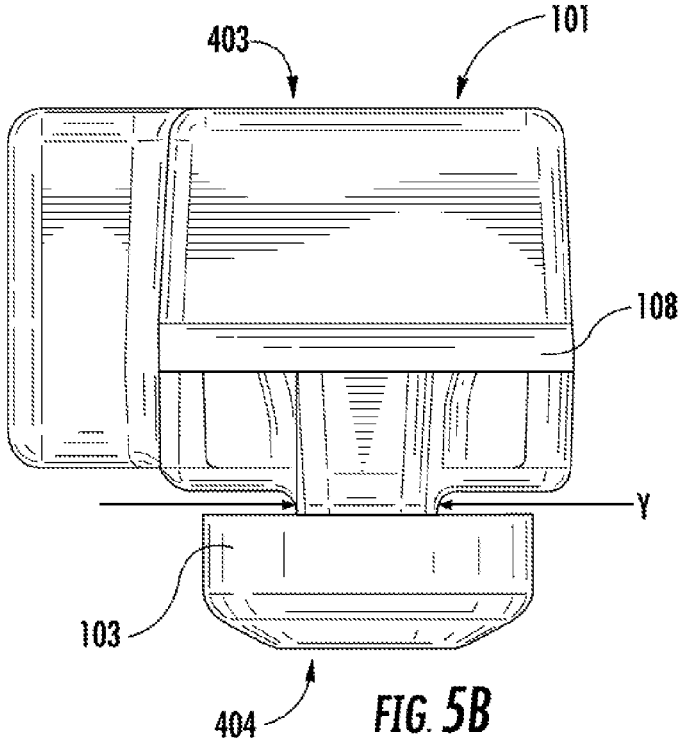
FIG. 5B is a front end view of the slide element of the slide fastener of FIG. 2A.
Figure 5C:
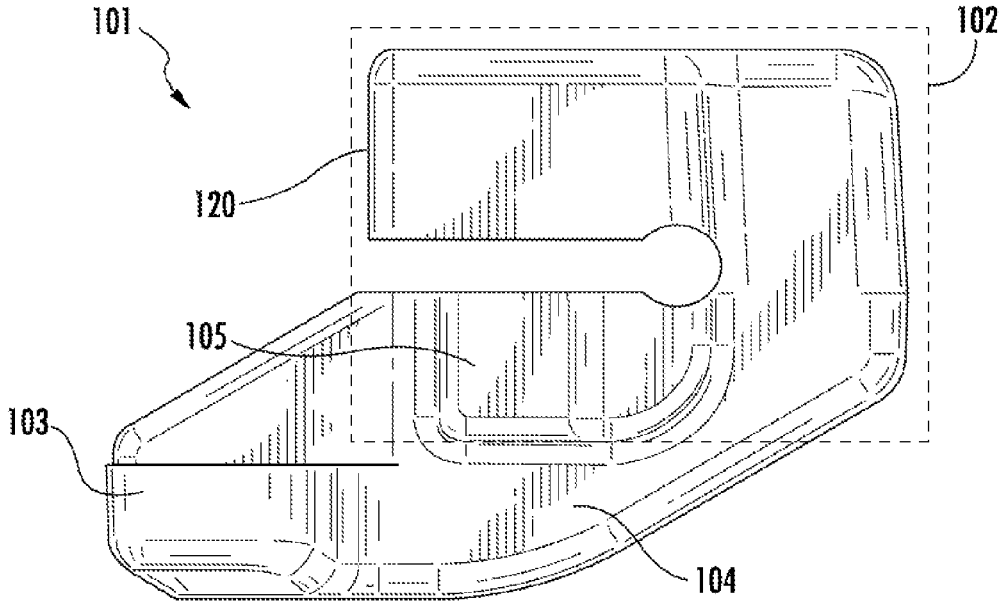
FIG. 5C is a side view of the slide element of the slide fastener of FIG. 2A.
Figure 6:
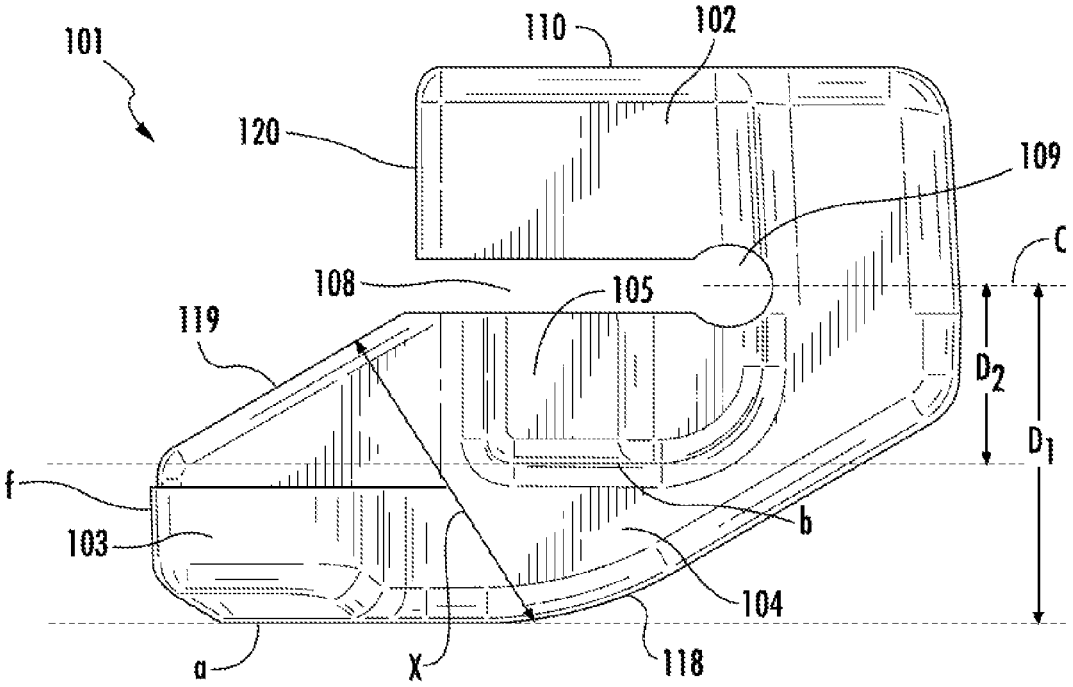
FIG. 6 is a side view of the slide element of the slide fastener of FIG. 2A.

One example of a slide element 101 is shown in isolation in FIGS. 2A-2B and FIGS. 4A-6. The slide element 101 includes a base 102, a head 103, a neck 104, a top surface 110, a facing surface 120, and one or more shoulders 105. As shown in FIGS. 4A-5B, the slide element 101 includes a front portion 401, a rear portion 402, a top portion 403, and a bottom portion 404. The one or more shoulders 105 include the lowermost surfaces b of the base 102 as shown in FIG. 6.

The slide element 101 may also include a protrusion 106 (see bottom view of FIG. 2A) extending in the longitudinal direction and a corresponding recess 107 (see top view of FIG. 2B) configured to interface with a complementary protrusion 106 of an adjacent slide element 101 from the same row. The interface between corresponding protrusions 106 and recesses 107 can be seen in FIG. 1A through tape 201 (where tape 201 is shown transparent). The protrusions 106 and recesses 107 are disposed on an opposite side of the slide element 101 from the facing surface 120. As shown in FIG. 5C, the facing surface 120 is the forwardmost surface of the base.

Figure 2A:
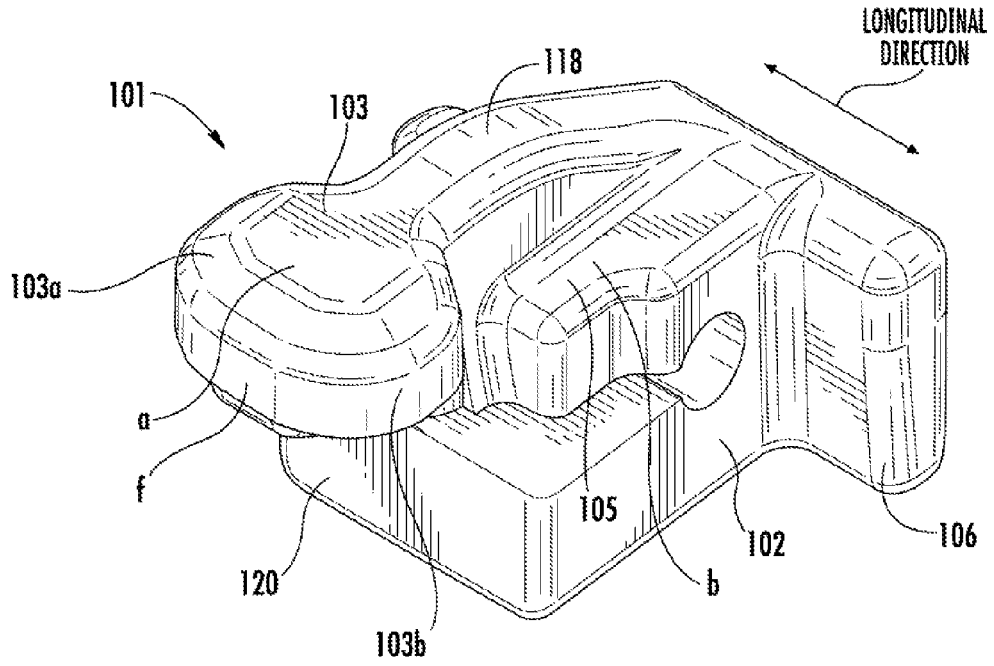
FIG. 2A is a bottom perspective view of a slide element of the slide fastener of FIG. 1A.

As shown in FIG. 2A, the head 103 includes first and second protrusions 103*a* and 103*b* (extending opposite one another along the longitudinal direction) configured to interface with the protrusions of a head 103 of a corresponding slide element 101 from the opposite row. Further, the head 103 interfaces with two corresponding shoulders 105 from slide elements from the opposite row (see FIG. 1B). In particular, the first protrusion 103*a* may include an upper surface 103*a*-1 (see FIGS. 2B and 4A) configured to interface with a first shoulder 105 of a first slide element from a second row and the second protrusion 103*b* may include an upper surface 103*b*-1 (see FIG. 4A) configured to interface with a second shoulder 105 of a second slide element from a second row.

Figure 3A:
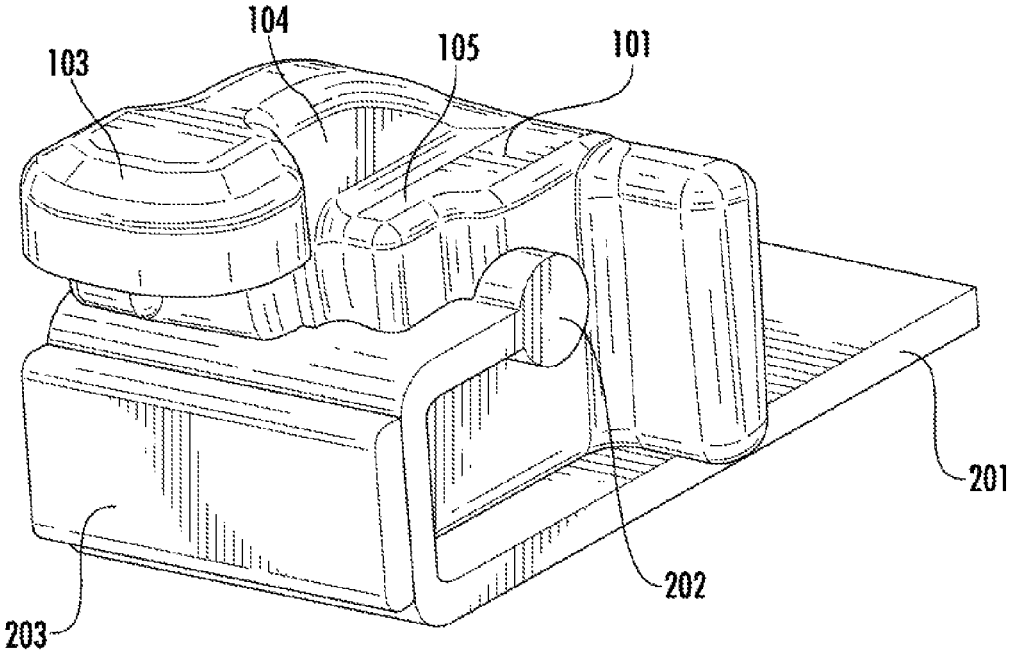
FIG. 3A is a partial perspective view of the slide fastener of FIG. 1A.
Figure 3B:
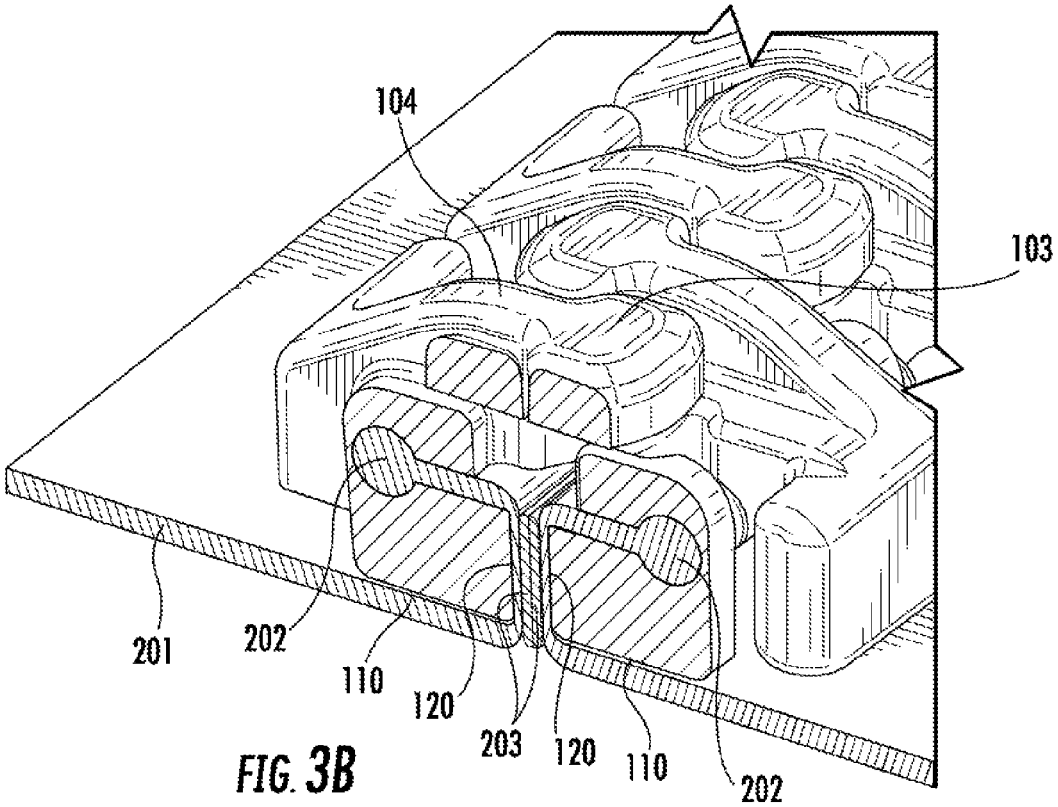
FIG. 3B is a perspective view of a cross-section of the slide fastener of FIG. 1A taken along the line 3B-3B of FIG. 1B.
Figure 4A:
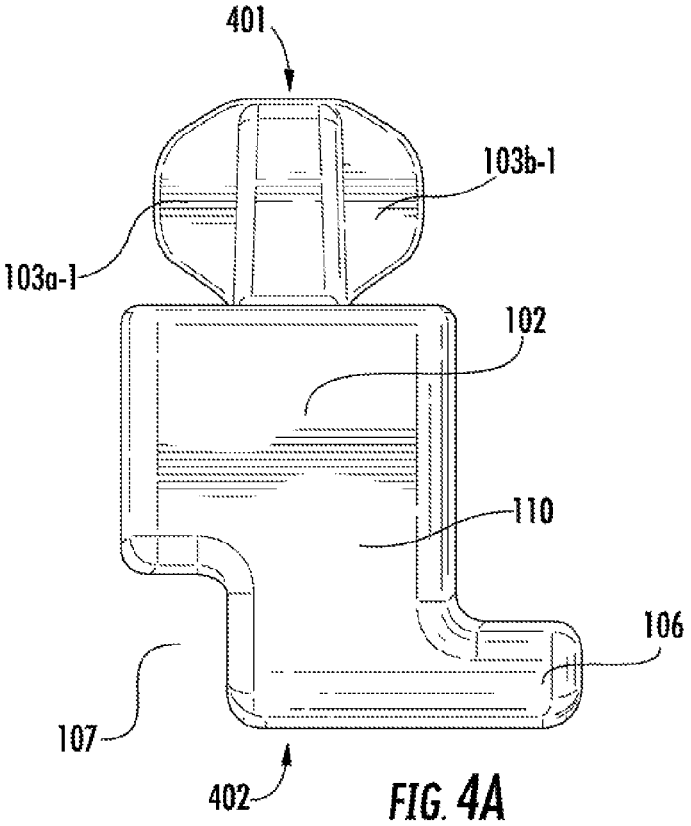
FIG. 4A is a top view of the slide element of the slide fastener of FIG. 2A.
Figure 4B:
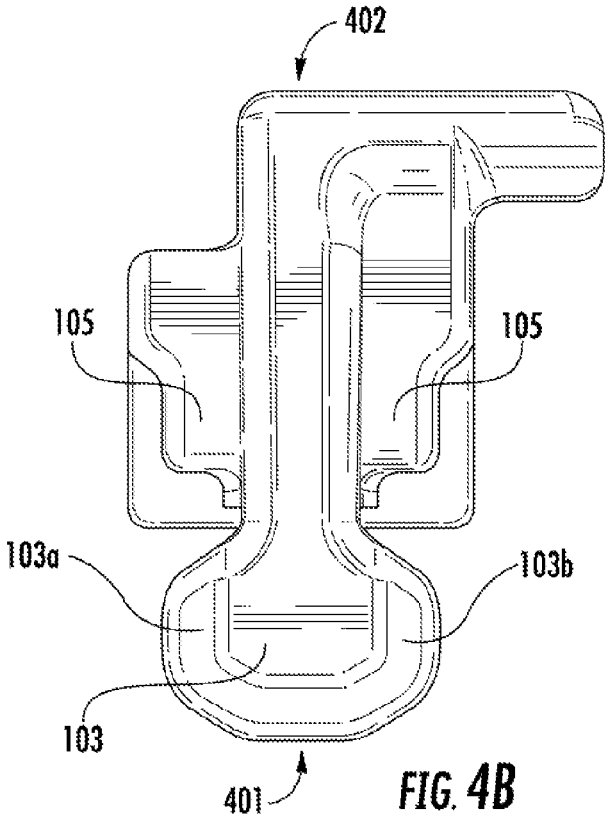
FIG. 4B is a bottom view of the slide element of the slide fastener of FIG. 2A.

As shown in FIGS. 3A and 3B, in some examples, the tape 201 includes a cord 202 that may be inserted into a through hole 108 of the slide element 101. For example, as shown in FIG. 6, the through hole 108 may include an enlarged portion 109 that approximately corresponds to the shape of the cord 202 and that is dimensioned to receive the cord 202. The through hole 108 may extend through the slide element 101 approximately parallel to the longitudinal direction. In some cases, the enlarged portion 109 and the cord 202 are both approximately cylindrical, although they need not be. The cord 202 may function as an anchor to secure the tape 201 in position such that the tape 201 can be pulled taut when wrapped around the slide element 101 in such a way that a portion of the tape 201 is pressed against facing surface 120 of the slide element 101 and a portion covers the top surface 110 of the slide element 101, as illustrated in FIGS. 3A and 3B. When the slide elements 101 are engaged with the slide elements from the opposite row, the tape 201 is configured to wrap around and cover the top surfaces 110 of the slide elements 101 such that the slide elements 101 are concealed. In other words, when the slide elements 101 are engaged/locked, the only components that are visible from the top side of the tape 201 are the tape 201 and any sealing layers (e.g., 203 and/or 204, described below).

Figure 2B:
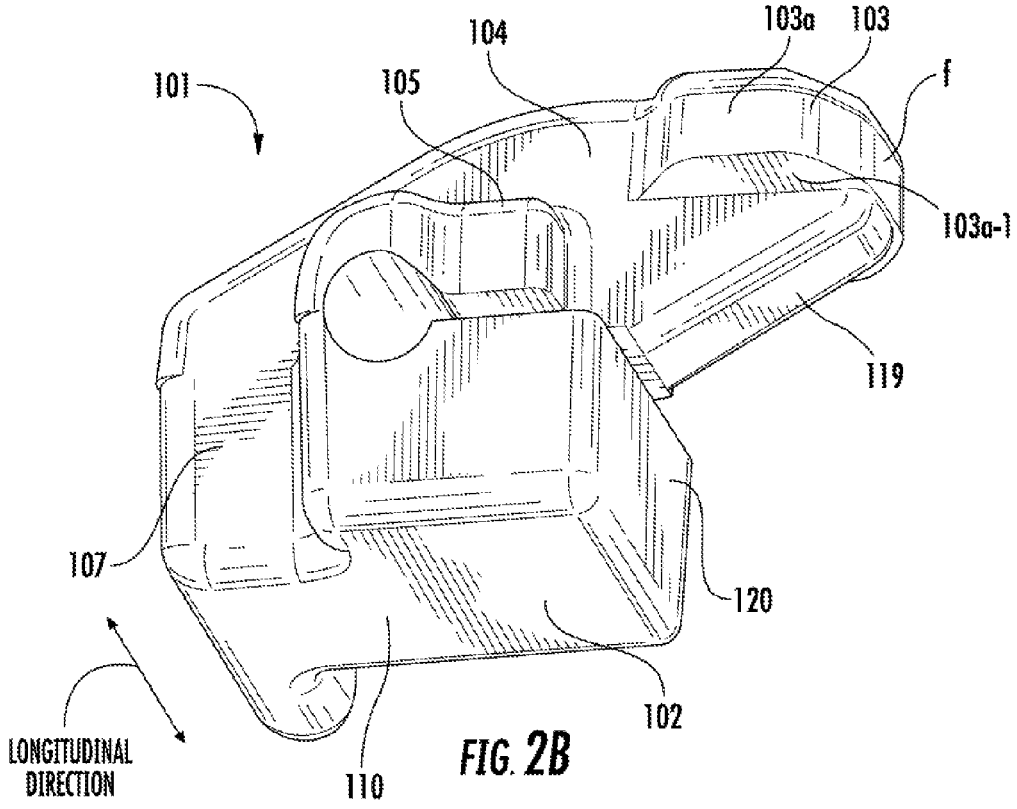
FIG. 2B is a top perspective view of the slide element of FIG. 2A.

Referring back to FIGS. 2A and 2B, the head 103 of the slide element 101 is disposed below (toward the bottom portion 404) the base 102 and forward (toward the front portion 401) of the base 102. In some examples, as shown in FIG. 5C, due to the configuration of the neck 104, the head 103 (including the two protrusions 103*a* and 103*b*) is disposed both (i) below the base 102 toward the bottom portion 404 and (ii) forward of the base 102 toward the front portion 401. In this way, the head 103 is offset from the base 102 in two planes: the horizontal plane and the vertical plane. More specifically, the majority of the head 103 is disposed below the lowermost surface b of the base 102 (i.e., shoulder 105), and the majority of the head 103 is disposed forward of the facing surface 120 of the base 102. As shown in FIG. 2B, the rearmost part of the head 103 may be generally in line with the facing surface 120. As illustrated in FIGS. 2A, 2B and 6, a forwardmost surface f of the head 103 is contained within a plane that is offset toward a front portion 401 of the slide element 101 from a plane containing the facing surface 120 of the base 102, where the facing surface 120 is the forwardmost surface of the base 102. In some cases, the base 102 is an approximate box shape such that it is approximately rectangular when viewed from multiple sides.

FIG. 6 shows a centerline C of the enlarged portion 109 (configured to secure the cord 202 of the tape 201) and its relative position with respect to portions of the slide element 101. In some examples, the neck 104 is configured such the lowermost surface a of the head 103 is a greater distance $D_1$ (in a vertical direction) from the centerline C than a distance $D_2$ of the lowermost surface b of the base 102 (i.e., shoulder 105) from the centerline C. The distance $D_1$ of surface a from the centerline C, in some cases, may be approximately double the distance $D_2$ between surface b and the centerline C. In some examples, the distance $D_1$ of surface a from the centerline C may be between approximately 2 mm and approximately 4 mm. In some examples, the distance $D_1$ of surface a from the centerline C may be between approximately 2.5 mm and approximately 3 mm. In some examples, the distance $D_1$ of surface a from the centerline C is approximately 2.7 mm. In some examples, the distance $D_2$ of surface b from the centerline C may be between approximately 0.5 mm and approximately 2.5 mm. In some examples, the distance $D_2$ of surface b from the centerline C may be between approximately 1 mm and approximately 2 mm. In some examples, the distance $D_2$ of surface b from the centerline C is approximately 1.4 mm.

The cross-sectional area of the neck 104 is defined by the width Y of the neck 104 and the length X of the neck 104 (see FIGS. 5B and 6). The length X is the distance between surface 119 at the upper portion of the neck 104 and surface 118 at the lower portion of the neck 104 (see dimension X in FIG. 6). The cross-sectional area of the neck 104 defined by length X and width Y is increased to provide high strength capabilities for transferring forces between the tape 201 and the head 103, an example of which is described in the following paragraph.

Figure 7A:
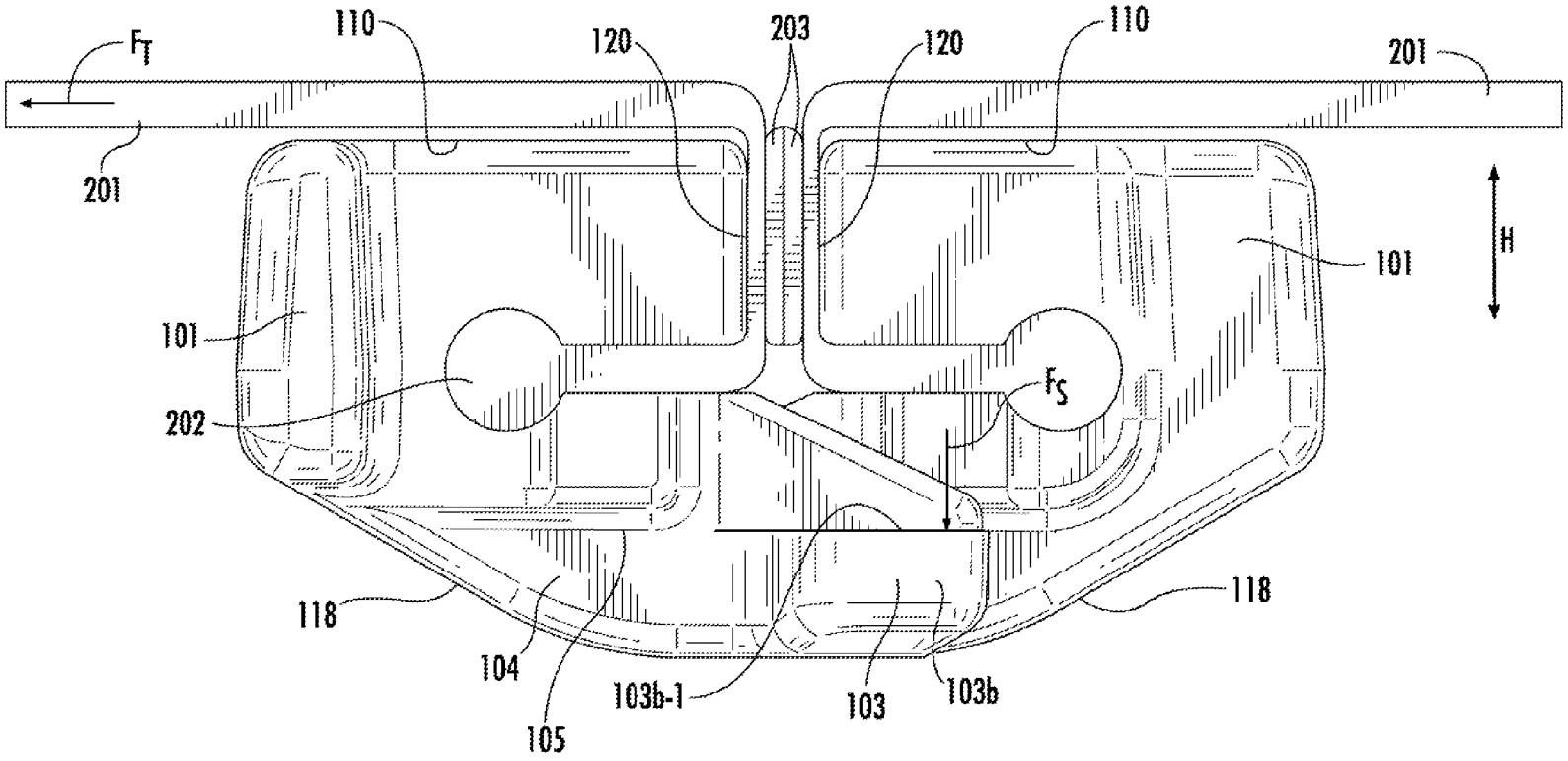
FIG. 7A is an end view of the slide fastener of FIG. 1A.

As mentioned above, one example of a horizontal force on the tape 201 is shown as tape force $F_T$ in FIG. 7A. FIG. 7A shows some of the forces applied to the left side slide element 101. The tape force $F_T$ (when viewed from the end view shown in FIG. 7A) tends to cause the slide element 101 to rotate in the counter-clockwise direction (about an axis perpendicular to the surface of FIG. 7A) and, if not counterbalanced, could cause damage or failure of the slide element 101. In some examples, the configuration of the neck 104 as described above results in one or more shoulder forces $F_S$ that offset at least some of the tape force $F_T$. If the head 103 of the slide element 101 has two protrusions 103*a* and 103*b* (each with upper surfaces 103*a*-1 and 103*b*-1, respectively), there will be two approximately equal shoulder forces $F_S$ as shown in FIG. 7A. The two shoulder forces $F_S$ occur at interfaces between each protrusion (103*a*, 103*b*) of the slide element 101 and a corresponding shoulder (105) of a slide element from the opposite row.

In some examples, as shown in FIG. 3A, the tape 201 includes a sealing layer 203. In some cases, sealing layer 203 is a resin layer. When the slide elements are engaged/locked, the sealing layer 203 of a first tape may be compressed against another sealing layer 203 of a second tape associated with the opposite row of slide elements 101 (see FIGS. 3B and 7A). The seal formed by the two sealing layers 203 compressed together may form a water-tight and/or air-tight seal. As shown in FIG. 7A, in some examples, the height of the sealing layer 203 approximately corresponds to a height H of the facing surface 120 of the slide element 101 such that the sealing layer 203 substantially covers the facing surface 120. In some cases, the sealing layer 203 is taller than the height H of the facing surface 120 and wraps around the slide element 101 to follow the contour of tape 201.

Figure 7B:
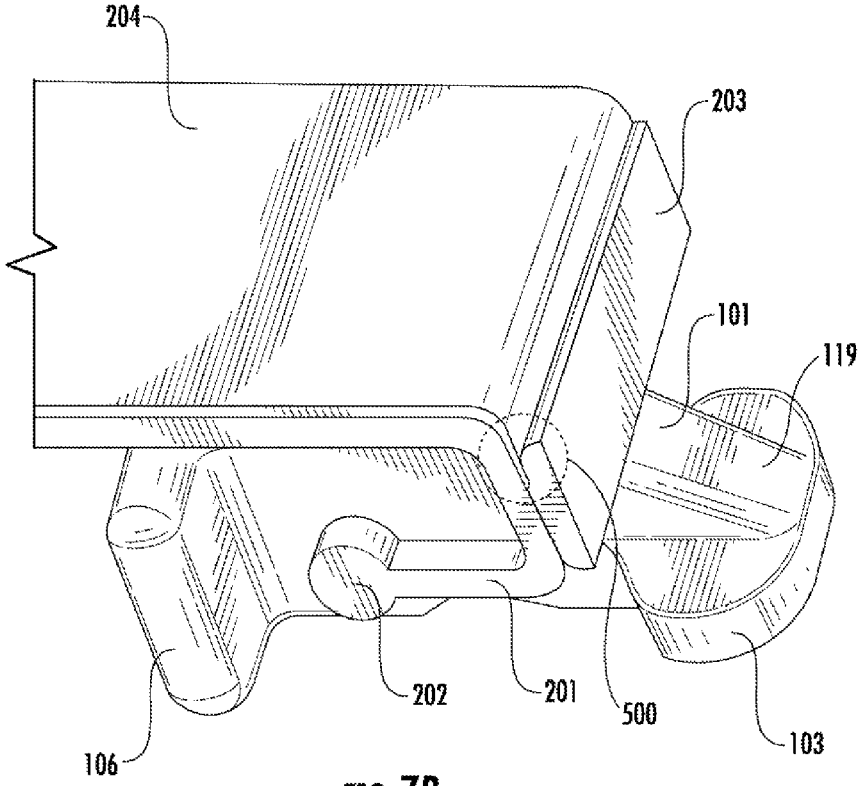
FIG. 7B is a partial perspective view of the slide fastener of FIG. 1A.

As shown in FIG. 7B, in some cases, a second sealing layer 204 is disposed between the slide element 101 and the first sealing layer 203 to form an overlap region 500 that includes three layers: tape 201, first sealing layer 203, and second sealing layer 204. The second sealing layer 204 may be configured to overlap the first sealing layer 203 such that the second sealing layer 204 covers some or all of the facing surface 120 of the slide element 101 and wraps around the slide element 101 and interfaces with top surface 110. In some examples, the second sealing layer 204 is a resin layer. The configuration of the sealing layers 203, 204 relative to the slide elements 101 may provide an improved seal. The one or more sealing layers may be formed by extrusion, lamination, coating, and/or by any other appropriate method.

Figure 8:
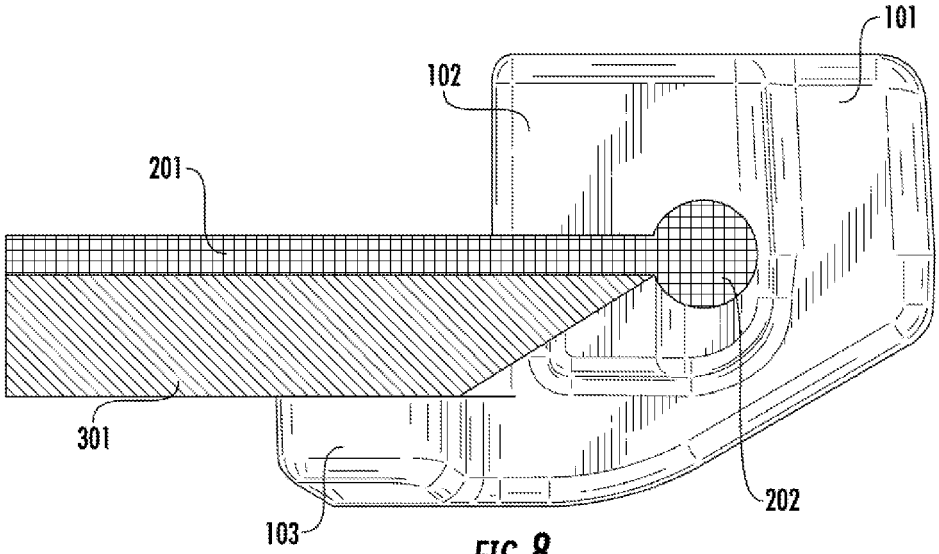
FIG. 8 is a side view of the slide element of the slide fastener of FIG. 2A, engaged with tape from FIG. 1A.

As shown in FIG. 8, during an exemplary manufacturing process, a slide core 301 is disposed adjacent to a location of the tape 201. The slide core 301 provides a flat surface to ensure a planar reference surface for molding the upper surfaces 103*a*-1 and 103*b*-1 of the two protrusions 103*a* and 103*b*, respectively, of the head 103.

The components of the slide fastener may be formed of materials including, but not limited to, nylon, polypropylene, non-woven polypropylene, other plastic materials, thermoplastic, metallic materials, other composite materials, cotton, wool, synthetic fabric, or other similar materials. Moreover, the components of the slide fastener may be attached to one another via suitable fasteners, which include, but are not limited to, glue or any suitable adhesive, hook and loop fasteners, ultrasonic welding, other mechanical or chemical fasteners.

Different arrangements of the components depicted in the drawings or described above, as well as components and steps not shown or described are possible. Similarly, some features and sub-combinations are useful and may be employed without reference to other features and sub-combinations. Cases of the invention have been described for illustrative and not restrictive purposes, and alternative cases will become apparent to readers of this patent. Accordingly, the present invention is not limited to the cases described above or depicted in the drawings, and various cases and modifications may be made without departing from the scope of the claims below.

That which is claimed is:

1. A slide fastener comprising:

a first row of slide elements extending along a longitudinal direction of the slide fastener;

a second row of slide elements extending approximately parallel to the first row and arranged adjacent to the first row in a width direction of the slide fastener which is perpendicular to the longitudinal direction, when the first and second rows are engaged with one another;

a first tape connected with the first row of slide elements at a first end of the first tape; and a second tape secured with the second row of slide elements at a first end of the second tape, wherein:

a vertical direction of each slide element is orthogonal to (i) the longitudinal direction of the slide fastener and (ii) the width direction of the slide fastener;

a forward and rear direction of each slide element is parallel to the width direction of the slide fastener;

each slide element of the first and second rows comprises a base, a head, a neck extending between the base and the head, a top surface, a facing surface, and one or more shoulders;

each base comprises an upper portion disposed above a through hole in the vertical direction and a lower portion disposed below the through hole in the vertical direction, wherein the upper and lower portions are integrally connected with each other at rear sides thereof;

the first tape is disposed in the through hole of the first row of slide elements and is configured to cover the facing surface and the top surface of each of the slide elements of the first row;

the second tape is disposed in the through hole of the second row of slide elements and is configured to cover the facing surface and the top surface of each of the slide elements of the second row; and a first vertical distance between a lowermost surface of the head and the first end of the first tape in the vertical direction is greater than a second vertical distance between a lowermost surface of the base and the first end of the first tape in the vertical direction.

2. The slide fastener of claim 1, wherein:

the neck of each slide element extends from the lowermost surface of the base such that the head is disposed below and forward of the lowermost surface of the base.

3. The slide fastener of claim 1, wherein each through hole extends through the respective slide element in a direction that is approximately parallel to the longitudinal direction of the slide fastener, each tape comprises a cord at the respective first end, and each through hole comprises an enlarged portion that corresponds to the respective cord.

4. The slide fastener of claim 3, wherein each slide element is configured so that:

the lowermost surface of the head is contained within a first plane that is offset toward a bottom portion of the slide element from a second plane containing the lowermost surface of the base; and a forwardmost surface of the head is contained within a third plane that is offset toward a front portion of the slide element from a fourth plane containing the facing surface of the base, wherein the facing surface is a forwardmost surface of the base.

5. The slide fastener of claim 1, wherein:

the head comprises two protrusions; and a majority of each of the two protrusions of the head are disposed both (i) below the base and (ii) forward of the base.

6. The slide fastener of claim 1, wherein:

the head of a slide element from the first row comprises a first protrusion and a second protrusion, wherein the two protrusions extend in opposite directions along the longitudinal direction of the slide fastener; and the first protrusion is configured to interface with a first shoulder from a first slide element of the second row and the second protrusion is configured to interface with a second shoulder from a second slide element of the second row.

7. The slide fastener of claim 6, wherein:

the first protrusion comprises an upper surface configured to contact the first shoulder; and the second protrusion comprises an upper surface configured to contact the second shoulder.

8. The slide fastener of claim 1, wherein the first vertical distance is approximately double the second vertical distance.

9. A slide fastener comprising:

a first row of slide elements extending along a longitudinal direction of the slide fastener;

a second row of slide elements extending approximately parallel to the first row and arranged adjacent to the first row in a width direction of the slide fastener which is perpendicular to the longitudinal direction, when the first and second rows are engaged with one another;

a first tape having a first end that is disposed in a through hole of each of the slide elements of the first row of slide elements; and a second tape having a first end that is disposed in a through hole of each of the slide elements of the second row of slide elements; wherein:

a vertical direction of each slide element is orthogonal to (i) the longitudinal direction of the slide fastener and (ii) the width direction of the slide fastener;

a forward and rear direction of each slide element is parallel to the width direction of the slide fastener;

each slide element comprises a base, a head, a neck extending between the base and the head, a top surface, a facing surface, and one or more shoulders;

each base comprises an upper portion disposed above the through hole in the vertical direction and a lower portion disposed below the through hole in the vertical direction, wherein the upper and lower portions are integrally connected with each other at rear sides thereof;

the slide elements are disposed such that the facing surfaces of the slide elements of the first row and the facing surfaces of the slide elements of the second row face one another;

the first tape is configured to cover the facing surface and the top surface of the slide elements of the first row;

the second tape is configured to cover the facing surface and the top surface of the slide elements of the second row;

the first and second tapes are pressed together between the first and second rows of slide elements when the first and second rows are engaged with one another;

in the vertical direction, a lowermost surface of the head of each of the slide elements is contained within a first plane that is offset toward a bottom portion of the slide element from a second plane containing a lowermost surface of the base; and in the forward and rear direction, a forwardmost surface of the head of each of the slide elements is contained within a third plane that is offset toward a front portion of the slide element from a fourth plane containing the facing surface of the base, wherein the facing surface is a forwardmost surface of the base.

10. The slide fastener of claim 9, wherein each through hole extends through the respective slide element in a direction that is approximately parallel to the longitudinal direction of the slide fastener, each tape comprises a cord disposed at the respective first end, each through hole comprises an enlarged portion that corresponds to the respective cord.

11. The slide fastener of claim 10, a first vertical distance between the lowermost surface of the head and the first end of the first tape is greater than a second vertical distance between the lowermost surface of the base and the first end of the first tape.

12. The slide fastener of claim 9, wherein:

the head comprises two protrusions; and a majority of each of the two protrusions of the head are disposed both (i) below the base and (ii) forward of the base.

13. The slide fastener of claim 9, wherein:

the first tape comprises at least one sealing layer disposed adjacent to the facing surfaces of the slide elements of the first row; and the second tape comprises at least one sealing layer disposed adjacent to the facing surfaces of the slide elements of the second row.

14. The slide fastener of claim 13, wherein:

the at least one sealing layer of the first tape follows a contour of the first tape and comprises (i) a portion adjacent to the facing surface of the slide elements of the first row and (ii) a portion adjacent to the top surface of the slide elements of the first row; and the at least one sealing layer of the second tape follows a contour of the second tape and comprises (i) a portion adjacent to the facing surface of the slide elements of the second row and (ii) a portion adjacent to the top surface of the slide elements of the second row.

15. The slide fastener of claim 13, wherein:

the at least one sealing layer of the first tape comprises a first sealing layer disposed adjacent to the facing surfaces of the slide elements of the first row and a second sealing layer disposed between the first tape and the first sealing layer such that the second sealing layer includes a portion adjacent to an upper surface of each slide element of the first row; and the at least one sealing layer of the second tape comprises a third sealing layer disposed adjacent to the facing surfaces of the slide elements of the second row and a fourth sealing layer disposed between the second tape and the third sealing layer such that the fourth sealing layer includes a portion adjacent to an upper surface of each slide element of the second row.

16. The slide fastener of claim 15, wherein the first and second sealing layers are layered on top of one another in a first overlap region and the third and fourth sealing layers are layered on top of one another in a second overlap region.

17. The slide fastener of claim 9, wherein:

the head of a slide element of the first row comprises a first protrusion and a second protrusion, wherein the first and second protrusions extend in opposite directions along the longitudinal direction; and the first protrusion is configured to interface with a first shoulder from a first slide element of the second row and the second protrusion is configured to interface with a second shoulder from a second slide element of the second row.

18. The slide fastener of claim 17, wherein:

the first protrusion comprises an upper surface configured to contact the first shoulder of a slide element from the second row; and the second protrusion comprises an upper surface configured to contact the second shoulder of a slide element from the second row.

19. The slide fastener of claim 11, wherein the first vertical distance is approximately double the second vertical distance.

20. A slide element of a slide fastener comprising:

a base comprising an upper portion disposed above a through hole in a vertical direction of the slide element and a lower portion disposed below the through hole in the vertical direction of the slide element, wherein the upper and lower portions are integrally connected with each other at rear sides thereof;

a head positioned below the base in the vertical direction and positioned in front of the base in a forward and rear direction of the slide element, wherein the forward and rear direction is perpendicular to the vertical direction; and a neck extending between the base and the head, wherein:

in the vertical direction of the slide element, a lowermost surface of the head is contained within a first plane that is offset toward a bottom portion of the slide element from a second plane containing a lowermost surface of the base; and in the forward and rear direction of the slide element, a forwardmost surface of the head is contained within a third plane that is offset toward a front portion of the slide element from a fourth plane containing a forwardmost surface of the base.

21. The slide fastener of claim 1, wherein:

each through hole comprises a planar portion that is approximately parallel to (i) the top surface of the slide element or (ii) the lowermost surface of the head.

22. The slide fastener of claim 9, wherein:

the neck of each slide element extends from the lowermost surface of the base such that the head is disposed below and forward of the lowermost surface of the base.

23. The slide fastener of claim 9, wherein:

each through hole comprises a planar portion that is approximately parallel to (i) the top surface of the slide element or (ii) the lowermost surface of the head.

24. The slide element of claim 20, wherein:

the neck of each slide element extends from the lowermost surface of the base such that the head is disposed below and forward of the lowermost surface of the base.

25. The slide fastener of claim 20, wherein:

each through hole comprises a planar portion that is approximately parallel to (i) a top surface of the slide element or (ii) the lowermost surface of the head.

* * * * *